US006567009B2

(12) United States Patent
Ohishi et al.

(10) Patent No.: US 6,567,009 B2
(45) Date of Patent: May 20, 2003

(54) LIGHT CONTROL TYPE LED LIGHTING EQUIPMENT

(75) Inventors: Masatoshi Ohishi, Zushi (JP); Toyotaro Tokimoto, Yokohama (JP); Fumio Imai, Nagoya (JP)

(73) Assignees: Avix Inc., Yokohama (JP); Central Japan Railway Company, Nagoya (JP)

( * ) Notice: Subject to any disclaimer, the term of this patent is extended or adjusted under 35 U.S.C. 154(b) by 132 days.

(21) Appl. No.: 09/748,842

(22) Filed: Dec. 27, 2000

(65) Prior Publication Data

US 2001/0005319 A1 Jun. 28, 2001

(30) Foreign Application Priority Data

Dec. 28, 1999 (JP) ..... 11-373470

(51) Int. Cl.[7] ..... G09F 9/33

(52) U.S. Cl. ..... 340/815.45; 340/815.65; 340/815.67; 340/825.69; 362/231; 362/233; 362/286; 362/555

(58) Field of Search ..... 340/815.4, 815.45, 340/815.65, 815.67, 825.69; 362/800, 227, 231, 233, 253, 286, 555; 359/597

(56) References Cited

U.S. PATENT DOCUMENTS

| | | | | |
|---|---|---|---|---|
| 5,374,876 A | * 12/1994 | Horibata et al. | ..... | 315/313 |
| 6,149,283 A | * 11/2000 | Conway et al. | ..... | 362/800 |
| 2002/0021573 A1 | * 2/2002 | Zhang | ..... | 362/555 |
| 2002/0048169 A1 | * 4/2002 | Dowling et al. | ..... | 362/234 |

FOREIGN PATENT DOCUMENTS

| | | |
|---|---|---|
| JP | 4-48584 | 2/1992 |
| JP | 6-52992 | 2/1994 |
| JP | 7-272863 | 10/1995 |

* cited by examiner

*Primary Examiner*—Daniel J. Wu
(74) *Attorney, Agent, or Firm*—Collard & Roe, P.C.

(57) ABSTRACT

An object of the invention is to provide a LED lighting equipment which can be simply perform lighting control of the light by any body and can obtain wide variety of tones in wide range by easy operation. A light control type LED lighting equipment comprises a LED aggregate lamp portion, control input generating means for generating one series of control input signal, control output generating means and individual power control means. A color tone of said LED aggregate lamp portion being varied continuously depending on the value of said control input signal.

6 Claims, 3 Drawing Sheets

LIGHT CONTROL TYPE LED LIGHTING EQUIPMENT

BACKGROUND OF THE INVENTION

1. Field of the Invention

The present invention relates generally to a lighting equipment to be used in a home, an office, a shop or the like. More particularly, the invention relates to a light control type LED lighting equipment driving LEDs with receiving power from an alternating current power source for serving as a light source.

2. Description of the Related Art

Since high-intensity blue LEDs have been put into practice, blue LEDs, red LEDs and green LEDs are aggregatedly mounted for forming a general lighting equipment similarly to a fluorescent lamp, a filament lamp and so forth. A lighting equipment employing LED aggregate lamps is particularly advantageous in comparison with existing fluorescent lamp, filament lamp and so forth for long life time and low power consumption. One of the advantages of the LED lamp is capability of freely varying color of a light emitted therefrom. Namely, by forming the lamp by aggregating LEDs of three primary colors and constructing a circuit for independently varying luminance of respective LED groups of three primary colors, a color tone of the light can be varied in a wide range.

In the lighting equipment with the LED aggregate lamp, a blue color adjusting knob variably adjusting luminance of the blue LEDs, a red color adjusting knob variably adjusting luminance of the red LEDs and a green color adjusting knob variably adjusting luminance of the green LEDs are provided. In this case, by variably operating the three adjusting knobs, the color tone of the light can be varied arbitrarily.

Usability of the light adjusting type lighting equipment is now considered. Consideration is given for the case where the light adjusting type lighting equipment is used in a supermarket for lighting goods/articles in the store. An owner or manager of the shop may attempt to promote willingness to buy of the customer by skillfully using sense of color given by the light from the equipment to a human. Therefore, for example, appropriate light may be employed which will match colors of respective goods/articles, such as by lighting a meet with reddish white color, by lighting a vegetable with bluish white color. However, it is difficult to obtain desired delicate color tone by combination of three primary colors such as "reddish white color", "bluish white color" and so forth, with three adjusting knobs. The reason is that patterns of combination by three adjusting knobs are present in infinite number. This is equally applicable as lighting for a living room at home, mood lighting in a shop of bar, club or the like.

On the other hand, by using high level concept, such as color difference and so forth, it has been considered to reduce number of adjusting knobs. However, such a concept as "color difference" is too technical for general users to understand real feeling in light adjustment. It is further difficult to reproduce the same condition in light adjustment.

On the other hand, there is a system, in which several tones are preliminarily prepared and a desired tone is appropriately selected by the user. However, sense of color in the provided tone is discrete and cannot express delicate tone.

Furthermore, an operation input portion, such as adjusting knobs for respective lighting colors are often secured on a wall or the like to degrade convenience in adjustment. It would be desirable to adjust the lighting color in the sense as varying television channel by remote control operation.

SUMMARY OF THE INVENTION

The present invention has been worked out for solving the shortcoming in the prior art. Therefore, an object of the present invention is to provide a LED lighting equipment which can be simply perform lighting control of the light by any body and can obtain wide variety of tones in wide range by merely operating one operation knob on a remote controller variably.

According to one aspect of the present invention, a light control type LED lighting equipment comprises:

- a LED aggregate lamp portion, in which a first color LED group, a second color LED group and a third color LED group are included;
- an alternating current power connecting portion for being connected to a power source;
- a power source converting portion for rectifying an alternating current power received through the alternating current power connecting portion;
- a first color drive circuit, a second color drive circuit and a third color drive circuit for supplying power for respective of the first color LED group, the second color LED group and the third color LED group by an output of the power source converting portion so as to illuminate the LED groups;
- control input generating means for generating one series of control input signal, a value of the control input signal increasing or decreasing within a predetermined range in response to operation by a user;
- control output generating means for generating a combination of first color luminance data, a second color luminance data and a third color luminance data corresponding to a value of the control input signal according to a predetermined characteristics; and
- individual power control means for independently controlling the first color drive circuit, the second color drive circuit and the third color drive circuit on the basis of the first color luminance data, the second color luminance data and the third color luminance data for varying power supply amount for the first LED group, the second LED group and the third LED group,
- a color tone of the LED aggregate lamp portion being varied continuously depending on the value of the control input signal according to a predetermined primary curve set in a chromaticity coordinate.

The light control type LED lighting equipment may further comprises:

- second control input generating means for generating one series of second control signal, a value of the second signal increasing or decreasing within a predetermined range by operation of the user;
- common power control means for uniformly varying power supply amount for the first color LED group, the second color LED group and the third color LED group by uniformly increasing or decreasing amount of current value of the first color drive circuit, the second color drive circuit and the third color drive circuit depending upon a value of the second control input signal,
- the hue of the LED aggregate lamp substantially maintained while brightness of the lighting is varied.

The first color drive circuit, the second color drive circuit and the third color drive circuit may be constant current type, and the individual power control means individually varies power supply amount for the first color LED group, the second color LED group and the third color LED group by a pulse width modulation method.

The light control type LED lighting equipment may further comprises:

second control input generating means for generating one series of second control signal, a value of the second control signal increasing or decreasing within a predetermined range by operation of the user;

common power control means for uniformly varying power supply amount for the first color LED group, the second color LED group and the third color LED group by varying output from the power source converting portion depending upon a value of the second control input signal, the hue of the LED aggregate lamp substantially maintained while brightness of the lighting is varied.

The LED aggregate lamp portion, the alternating current power connecting portion, the power source converting portion, the first color drive circuit, the second color drive circuit, the third color drive circuit, the control output generating means including a control signal receiving portion and the individual power control means are mounted on the lighting equipment main body, the control input generating means including a control signal transmitting portion is mounted on a remote controller separated from the main body, the control signal transmitting portion being connected to the control signal receiving portion through a ratio transmission line.

According to another aspect of the present invention, a light control type LED lighting equipment comprises:

a LED aggregate lamp portion, in which a first color LED group, a second color LED group and a third color LED group are included;

a first color drive circuit, a second color drive circuit and a third color drive circuit for supplying power for respective of the first color LED group, the second color LED group and the third color LED group so as to illuminating the LED groups;

control input generating means for generating one series of control input signal, a value of the control input signal increasing or decreasing within a predetermined range in response to operation by a user;

control output generating means for generating a combination of first color luminance data, a second color luminance data and a third color luminance data corresponding to a value of the control input signal according to a predetermined primary curve set in a chromaticity coordinate; and individual power control means for independently controlling the first color drive circuit, the second color drive circuit and the third color drive circuit on the basis of the first color luminance data, the second color luminance data and the third color luminance data for varying power supply amount for the first LED group, the second LED group and the third LED group, wherein a color tone of the LED aggregate lamp portion being varied continuously depending on the value of the control input signal.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscurity of the present invention.

Figure 1:
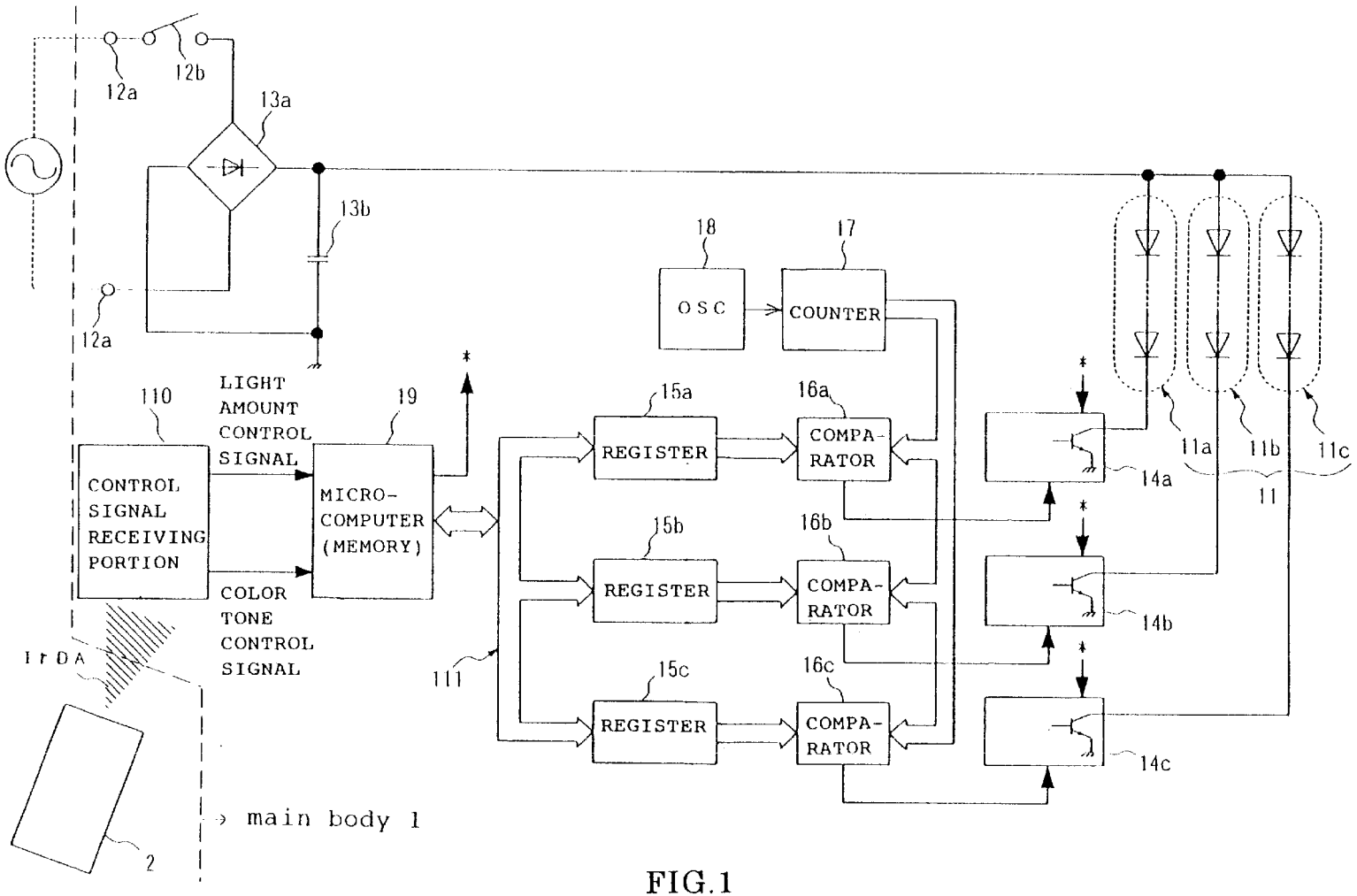
FIG. 1 is a block diagram showing a general circuit diagram of one embodiment of a light control type LED lighting equipment according to the present invention.

FIG. 1 is a circuit diagram of one embodiment of a light control type LED lighting equipment according to the present invention. The LED lighting equipment has a main body having a LED aggregate lamp portion 11 as a light source and a remote controller 2 communicating with the main body 1 through a radio transmission line.

The LED aggregate lamp portion 11 is formed by installing a red LED group 11*a*, a green LED group 11*b* and a blue LED group 11*c* to form an optical system dispersing a light well admixed red, green and blue lights. Electrically, a large number of red LEDs are appropriately connected in series and/or parallel to form the red LED group 11*a*. Also, a large number of green LEDs are appropriately connected in series and/or parallel to form the green LED group 11*b*, and a large number of blue LEDs are appropriately connected in series and/or parallel to form the blue LED group 11*c*.

An alternating current power source connecting portion of the main body 1 is a power source plug 12*a* adapted to a consent of generally 100V of commercial alternating current power source. By connecting the power source plug 12*a* to the effective power source consent and turning ON the power source switch 12*b*, an alternating current power is applied to a power source converting portion including a diode bridge rectifier circuit 13*a* and a capacitor 13*b* for rectification and smoothing to convert into a direct current power source. To an output of the power source converting portion, the red LED group 11*a*, the green LED group 11*b* and the blue LED group 11*c* forming the aggregate lamp portion 11 are connected in parallel. A red driving circuit for applying power for illuminating the red LEDs in the red LED group 11*a* is connected to the direct current power source line of the red LED group 11*a*. Similarly, a green driving circuit for applying power for illuminating the green LEDs in the green LED group 11*b* is connected to the direct current power source line of the green LED group 11*b*, and a blue driving circuit for applying power for illuminating the blue LEDs in the blue LED group 11*c* is connected to the direct current power source line of the blue LED group 11*c*. By connecting the driver circuits for respective colors of LED groups, a driving system for driving respective colors of LED groups for illumination is constructed. The driver circuits for respective colors comprise constant current type drivers 14*a*, 14*b* and 14*c*, registers 15*a*, 15*b* and 15*c* and comparators 16*a*, 16*b* and 16*c*, and are connected to an oscillation circuit 18 via a counter 17. Components and operation of the driving system will be discussed in detail.

A main component in a processing system of the main body 1 is a microcomputer 19 including a built-in memory. The microcomputer 19 has an input connected to a control signal receiving portion 110 and an output connected to the driving system via a bus 111. A controller 2 transmits a control signal to the control signal receiving portion 110.

The remote controller 2 has a liquid crystal display portion of character display on the surface of a casing, an operation input portion for input operation by the user, a control signal transmitting portion transmitting a control signal as IrDA for illumination of the main body on the basis of an input through the operation input portion signal and a microcomputer connected to these components through bus for concentrated control.

The operation input portion has a first control input generating means and a second control input generating means. These control input generating means are comprised of a plurality of buttons and knobs for being operated by the user, and a variable resistor or a rotary encoder for lighting adjustment. Each of these control generating means generates one series of control input signals, the values of which increase and decrease within predetermined ranges.

The first control input generating means is means for inputting a command for independently controlling luminance of the red LED group 11*a*, the green LED group 11*b* and the blue LED group 11*c* to generate a color tone input signal (hereinafter referred to as color tone input means). The second control input generating means is means for inputting command for uniformly controlling luminance (brightness) of the LED aggregate lamp 15 and generating a light amount input signal (hereinafter referred to as light amount input means). Next, discussion will be given for controlling driving of the LED groups on the basis of these input signals.

<<LED Group Drive Control>>

When the user performs predetermined input operation with watching, for example, alphanumeric characters displayed on the liquid crystal display portion by the light amount and color tone control input means, the microcomputer of the controller 2 sets the light amount and the color tone input signals generated in response to the input operation. Then, when the user performs predetermined operation, the microcomputer transmits IrDA signal corresponding to the set input signal to the control signal receiving portion 110 of the main body 1.

The microcomputer 19 of the main body 1 individually processes the received IrDA signal as the light control signal and the color tone control signal.

The light amount control signal is input to the microcomputer 19 as a common signal to a current setting terminals of the respective drivers 14*a*, 14*b* and 14*c*. By uniformly increasing or decreasing the current value flowing through respective drivers 14*a*, 14*b* and 14*c* depending upon the light amount control signal, the supply power to the respective LED groups 11*a*, 11*b* and 11*c* increases or decreases uniformly. Namely, by input operation from the light amount input means of the remote controller 2, the luminance level of the LED groups 11*a*, 11*b* and 11*c* is varied uniformly.

In the shown embodiment, independently of uniform control of luminance, the luminance level of each of the LED groups 11*a*, 11*b* and 11*c* can be controlled independently of each other. This color tone control is performed by a pulse width modulation method on the basis of the color tone control signal as another control signal. Namely, the color tone control signal is input to an A/D converter terminal of the microcomputer. Then, predetermined conversion process is performed to output 8-bit red luminance data, green luminance data, blue luminance data as converted outputs to be a base of luminance level control. Respective registers 15*a*, 15*b* and 15*c* latch the red luminance data, the green luminance data and the blue luminance data. The 8-bit red luminance data, green luminance data, blue luminance data thus latched become data for determining pulse width of the drive pulse for driving the red LED group 11*a*, the green LED group 11*b* and the blue LED group 11*c* for illumination at respectively independent luminance level. The driving system for respective of three primary colors of RGB is identical with each other. Therefore, the following discussion will be given for the control system of the red color illumination as an illustration.

By the oscillation circuit 18, sufficiently high constant frequency of clock pulses are continuously generated. By the clock pulse, scale-of-256 ($=2^8$) counter 17 is incremented to repeatedly vary the 8-bit counted value of the counter from all "0" to all "1" with a given period Ts. By comparing the 8-bit counted value with the 8-bit level data latched by the register 15*a* by a digital comparator 16*a*, a drive pulse corresponding to 8-bit level data corresponding to the pulse width Tw and the period being Ts, is output from the digital comparator 16*a*. Namely, the driver 14*a* supplies a given current for the red LEDs for the period corresponding to the pulse width Tw of the drive pulse for illuminating the red LEDs. This pulse illumination is repeated at a period Ts.

As set forth above, by input operation from the color tone input means of the remote controller 2, luminance levels of respective colors of LED groups 11*a*, 11*b* and 11*c* are varied independently. The process for converting the color tone control signal input to the A/D conversion terminal of the microcomputer 19 into the red luminance data, the green luminance data and the blue luminance data is particular feature of the invention. Therefore, conversion process will be discussed.

<<Generation of Luminance Data for Each Color>>

The microcomputer 19 digitizes an analog color tone control signal input to the A/D conversion terminal at 256 levels depending upon magnitude of the color tone control signal. The digital value thus converted into the corresponding level is stored as color tone parameter in an address space prepared for color tone parameter. The microcomputer 19 executes a predetermined logic program stored in a memory with taking the color tone parameter as input to obtain a coordinate value (Y, x, y) on a primary curve preliminarily determined by chromaticity coordinates. Subsequently, the microcomputer 19 further executes the logic program to obtain respectively 8-bit data of the red color luminance, the green color luminance and the blue color luminance on the basis of three coordinate values Y, x, y. These luminance data is output to the drive system as set forth above.

Figure 2:
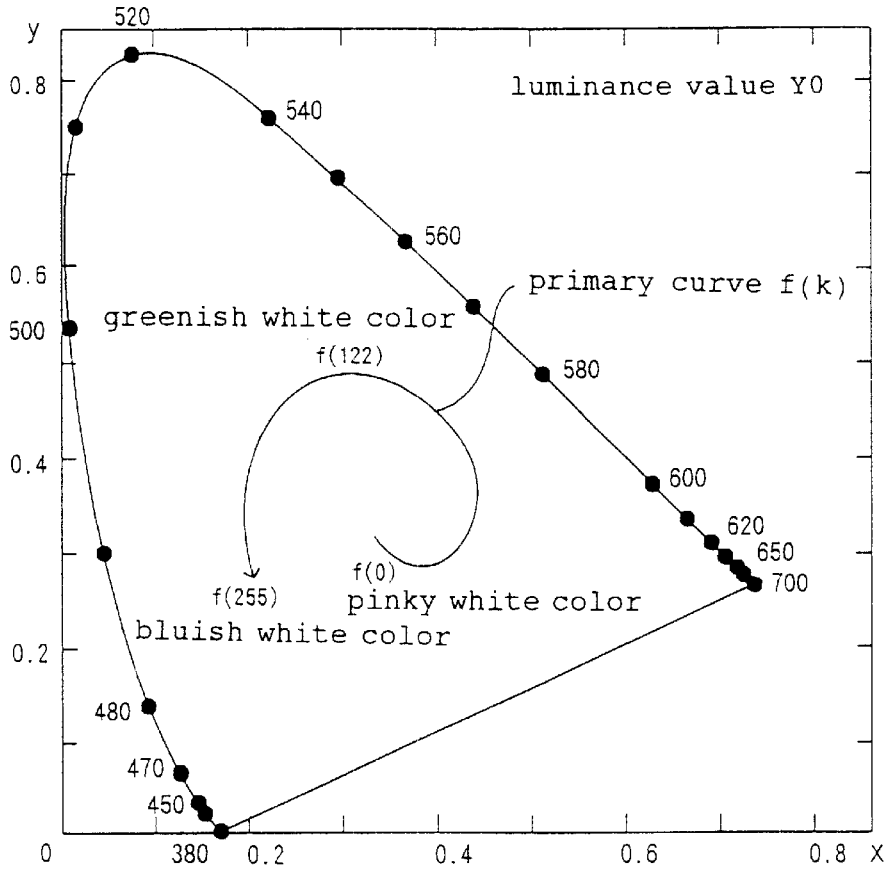
FIG. 2 is a xy chromaticity diagram generally showing a primary curve relating to one embodiment of the present invention.

In the shown embodiment, the chromaticity coordinate is a spatial coordinate system formed by overlaying a plurality of the same luminance surfaces (xy chromaticity chart) in luminance axis direction. By the coordinate value (Y, x, y) at certain one point in the coordinate system, these attribute of the color (brightness, hue and richness of the color) are determined in unambiguous manner. Y corresponds to the brightness of the color, and (x, y) correspond to hue and richness of the color respectively. On the other hand, the primary curve is an arbitrary sequential curve function arranged in the chromaticity coordinates, in which three coordinate values Y, x and y are provided for one input value (=value of color tone designating parameter). As a particular example, a primary curve on a xy chromaticity chart of the luminance value Y0 is shown in FIG. 2. According to the primary curve f(k) of FIG. 2, as the color tone designation parameter k increases from 0 to 255, the color tone is varied continuously, such as "pinky white color"→"greenish white color"→"bluish white color". By varying the color tone continuously, such an intermediate color as one between "pinky white color" and "greenish white color" and other delicate color tones can be expressed. BY preparing a plurality of patterns of the primary curve f(k) and storing in the memory of the microcomputer 19, desired color tone may be selected depending upon application, time, season and so forth to permit light control to be done more easily and with a wider variation.

On the other hand, by establishing the primary curve in spiral form expanding in the luminance direction, a plurality of mutually distinct combinations of luminance values and the color tone can be provided continuously with one parameter. For example, it becomes possible to express various colors from "bright bluish white color" to "dark reddish white color. Sense of color corresponding to the curve varies from "beamish" to "calm". By preparing a plurality of patterns of the primary curve f(k) and storing them in the memory of the microcomputer 19, desired color tone may be selected depending upon application, time, season and so forth, lighting closely fitting to preference desire of the user becomes possible. On the other hand, in viewpoint of the hardware, elements associated with the light amount input means are integrated with the color tone input means, overall construction of the lighting equipment can be significantly simplified.

Figure 3:
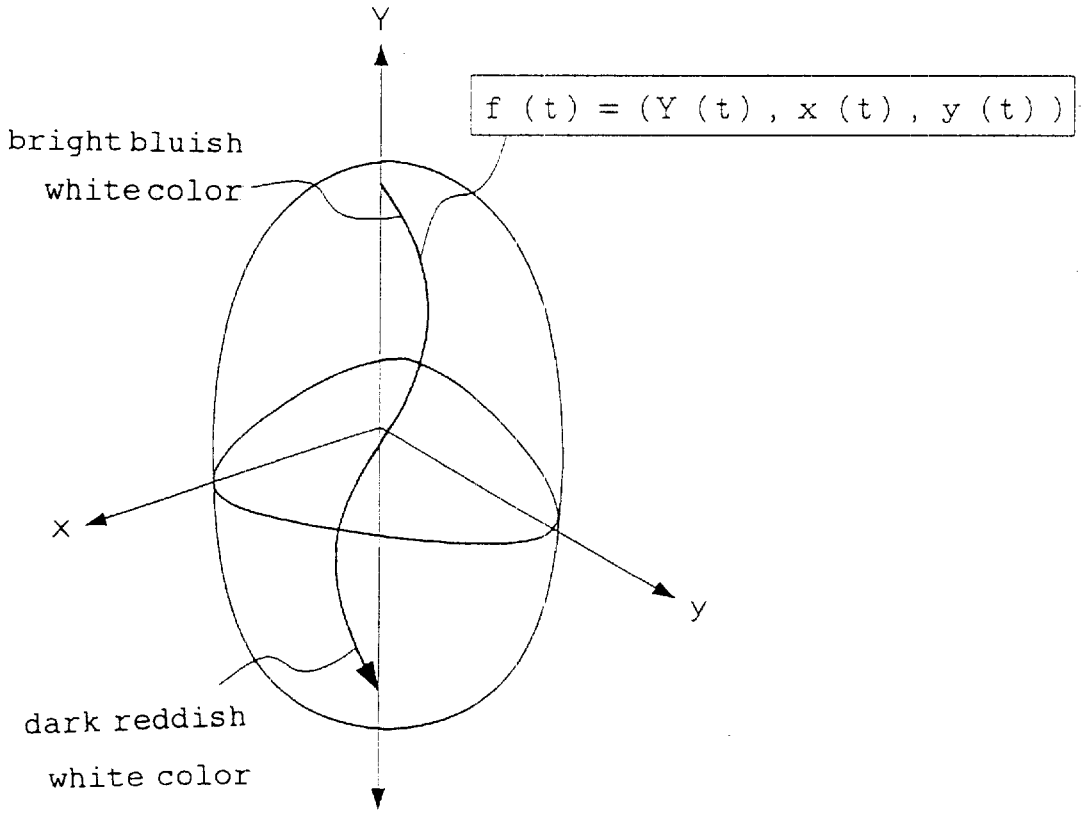
FIG. 3 is a general illustration of the primary curve of spiral shape relating to one embodiment of the present invention.

Furthermore, by taking a time t as a parameter for the primary curve (see FIG. 3), a timer function (or simple scheduling function) may be added to the lighting equipment, such as varying the luminance and the color tone along a predetermined zone of the curve in a predetermined unit time period. For example, by employing this function in lighting in a bed room, comfortable sleep may be attained in continuously changing mood. Also, by setting to automatically turn off the light after a certain time period, it may contribute to power saving. Also, in a night club, by automatically varying the lighting from "stimulating lighting"→"calm lighting"→"lighting encouraging returning home" so that the customer enjoy a given time and turning over ratio of the customer can be improved.

<<Modifications>>

As a second embodiment of the present invention, a common power control means may be provided at the downstream side of the power source converting portion. The microcomputer 19 controls the common power control means on the basis of the light amount control signal originated by input operation through the light amount input means of the remote controller 2. Namely, if the light amount control signal is "small", the output of the power source converting means is lowered by the common power control means, and otherwise, the output is increased. Accordingly, by the input operation from the light amount control means of the remote controller 2, the luminance levels of respective colors of LED group can be varied uniformly.

Also, in the foregoing two embodiments, by control of the light amount input means of the remote controller 2, the luminance can be varied with maintaining hue of the LED aggregate lamp portion substantially unchanged. Thus, the color tone of the lighting light can be adjusted in a wide range.

With the light control type LED lighting equipment according to the present invention, a color tone of the LED aggregate lamp portion being varied continuously according to a predetermined primary curve. The curve is set in a chromaticity coordinate depending on the value of the one series of control input signal generated by the control input signal generating means. By this arrangement, light control can be simply achieved only by varying operation of the control input generating means.

By providing another control input signal generating means which generates another series of control input signal, adjustment of the tone level of the LED aggregate lamp can be done by individual adjustment or uniform adjustment for variably controlling the tone level of the input signal independently to each other.

Furthermore, by providing the control input generating means in the remote controller separately from the lighting equipment, light control for the lighting can be done easily like remote control of a television.

While the present invention has been discussed in terms of the preferred embodiment, various modifications, omissions, additions and different designs without departing from the principle of the invention should be obvious to those skilled in the art. Therefore, the present invention should be understood as including all possible embodiments, modifications, omissions, additions and so forth which can be implemented without departing from the principle of the invention set forth in the appended claims.

What is claimed is:

1. A light control type LED lighting equipment comprising:

a LED aggregate lamp portion, in which a first color LED group, a second color LED group and a third color LED group are included;

a first color drive circuit, a second color drive circuit and a third color drive circuit for supplying power for respective of the first color LED group, the second color LED group and the third color LED group so as to illuminating the LED groups;

control input generating means for generating one series of control input signal, a value of said control input signal increasing or decreasing within a predetermined range in response to operation by a user;

control output generating means for generating a combination of first color luminance data, a second color luminance data and a third color luminance data corresponding to a value of said control input signal according to a predetermined primary curve set in a chromaticity coordinate; and individual power control means for independently controlling said first color drive circuit, said second color drive circuit and said third color drive circuit on the basis of said first color luminance data, said second color luminance data and said third color luminance data for varying power supply amount for said first LED group, said second LED group and said third LED group, wherein a color tone of said LED aggregate lamp portion being varied continuously depending on the value of said control input signal.

2. A light control type LED lighting equipment comprising:

a LED aggregate lamp portion, in which a first color LED group, a second color LED group and a third color LED group are included;

an alternating current power connecting portion for being connected to a power source;

a power source converting portion for rectifying an alternating current power received through said alternating current power connecting portion;

a first color drive circuit, a second color drive circuit and a third color drive circuit for supplying power for respective of the first color LED group, the second color LED group and the third color LED group by an output of said power source converting portion so as to illuminate the LED groups;

control input generating means for generating one series of control input signal, a value of said control input signal increasing or decreasing within a predetermined range in response to operation by a user;

control output generating means for generating a combination of first color luminance data, a second color luminance data and a third color luminance data corresponding to a value of said control input signal according to a predetermined characteristics; and individual power control means for independently controlling said first color drive circuit, said second color drive circuit and said third color drive circuit on the basis of said first color luminance data, said second color luminance data and said third color luminance data for varying power supply amount for said first LED group, said second LED group and said third LED group, a color tone of said LED aggregate lamp portion being varied continuously depending on the value of said control input signal according to a predetermined primary curve set in a chromaticity coordinate.

3. A light control type LED lighting equipment as set forth in claim 2, further comprising:

second control input generating means for generating one series of second control signal, a value of said second signal increasing or decreasing within a predetermined range by operation of the user;

common power control means for uniformly varying power supply amount for said first color LED group, said second color LED group and said third color LED group by uniformly increasing or decreasing amount of current value of said first color drive circuit, said second color drive circuit and said third color drive circuit depending upon a value of said second control input signal, a hue of said LED aggregate lamp maintained while brightness of the lighting is varied.

4. A light control type lighting equipment as set forth in claim 3, wherein said first color drive circuit, said second color drive circuit and said third color drive circuit have a constant current, and said individual power control means individually varies power supply amount for said first color LED group, said second color LED group and said third color LED group by a pulse width modulation method.

5. A light control type LSD lighting equipment as set forth in claim 2, further comprising:

second control input generating means for generating one series of second control signal, a value of said second control signal increasing or decreasing within a predetermined range by operation of the user;

common power control means for uniformly varying power supply amount for said first color LED group, said second color LED group and said third color LED group by varying output from said power source converting portion depending upon a value of said second control input signal, a hue of said LED aggregate lamp maintained while brightness of the lighting is varied.

6. A light control type LED lighting equipment as set forth in claim 2, wherein said LED aggregate lamp portion, said alternating current power connecting portion, said power source converting portion, said first color drive circuit, said second color drive circuit, said third color drive circuit, said control output generating means including a control signal receiving portion and said individual power control means are mounted on the lighting equipment main body, said control input generating means including a control signal transmitting portion is mounted on a remote controller separated from said main body, said control signal transmitting portion being connected to said control signal receiving portion through a radio transmission line.

* * * * *